US012467389B2

(12) United States Patent
Raimondi et al.

(10) Patent No.: US 12,467,389 B2
(45) Date of Patent: Nov. 11, 2025

(54) VALVE BRIDGE WITH INTEGRATED SPLINE BUSHING FOR LOST MOTION

(71) Applicant: Eaton Intelligent Power Limited, Dublin (IE)

(72) Inventors: Emanuele Raimondi, Turin (IT); Massimo D'Amore, Turin (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/715,133

(22) PCT Filed: Dec. 2, 2022

(86) PCT No.: PCT/EP2022/025549

§ 371 (c)(1),
(2) Date: May 31, 2024

(87) PCT Pub. No.: WO2023/099037

PCT Pub. Date: Jun. 8, 2023

(65) Prior Publication Data

US 2025/0043703 A1 Feb. 6, 2025

Related U.S. Application Data

(60) Provisional application No. 63/285,603, filed on Dec. 3, 2021.

(51) Int. Cl.

| | |
|---|---|
| ***F01L 1/26*** | (2006.01) |
| ***F01L 1/24*** | (2006.01) |
| *F01L 1/18* | (2006.01) |

(52) U.S. Cl.
CPC ..... *F01L 1/267* (2013.01); *F01L 1/2411* (2013.01); *F01L 1/181* (2013.01)

(58) Field of Classification Search
CPC ..... F01L 1/267; F01L 1/2411; F01L 1/181; F01L 1/26; F01L 13/00; F01L 13/0005; F01L 2013/10
(Continued)

(56) References Cited

U.S. PATENT DOCUMENTS

2001/0029923 A1 10/2001 Hannon et al.
2020/0300131 A1* 9/2020 Klampfer ..... F01L 13/0005

FOREIGN PATENT DOCUMENTS

WO 2019025511 2/2019
WO 2021164948 8/2021
WO WO-2021164948 A1 * 8/2021 ..... F01L 1/181

OTHER PUBLICATIONS

International Search Report and Written Opinion for PCT/EP2022/025549, dated Mar. 22, 2023, 7 pages.

* cited by examiner

*Primary Examiner* — Mark A Laurenzi
*Assistant Examiner* — Kelsey L Stanek
(74) *Attorney, Agent, or Firm* — Meunier Carlin & Curfman LLC

(57) ABSTRACT

A valve bridge assembly for an engine includes a main body configured to engage a distal end of at least one valve stem. A receiving body is movably disposed within a cavity of the main body between a first position and a second position. The receiving body includes at least one key-receiver. A piston body is movably attached to the main body and includes a key configured to be received into the key-receiver of the receiving body. When the receiving body is in the first position. the key-receiver feature and key are misaligned and a force applied to the piston body is transmitted to the at least one valve stem via the receiving body and the main body. When the receiving body is in the second position, the key-receiver and the key are aligned and a force
(Continued)

applied to the piston body causes the piston body to be displaced relative to the main body.

18 Claims, 12 Drawing Sheets

(58) Field of Classification Search
USPC ..... 123/90.1
See application file for complete search history.

VALVE BRIDGE WITH INTEGRATED SPLINE BUSHING FOR LOST MOTION

PRIORITY

This application claims the benefit of priority of U.S. provisional patent application Ser. No. 63/285,603, filed Dec. 3, 2021, the contents of which are incorporated herein by reference in their entirety.

FIELD

The subject application relates to, in general, a valve bridge for use in a valve train assembly. More particularly, this application relates to a valve bridge configured for valve deactivation and dual lift strategies.

BACKGROUND

Many internal combustion engines utilize rocker arms to transfer rotational motion of cams to linear motion appropriate for opening and closing engine valves. Deactivating a valve allows the rocker arm to move without transferring motion to the valve.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY OF THE INVENTION

There is provided a valve bridge assembly for an engine that includes a main body configured to engage a distal end of at least one valve stem. A receiving body is movably disposed within a cavity of the main body between a first position and a second position. The receiving body includes at least one key-receiver. A piston body is movably attached to the main body and includes a key configured to be received into the key-receiver of the receiving body. When the receiving body is in the first position, the key-receiver and key are misaligned and a force applied to the piston body is transmitted to the at least one valve stem via the receiving body and the main body. When the receiving body is in the second position, the key-receiver and the key are aligned and a force applied to the piston body causes the piston body to be displaced relative to the main body.

The foregoing valve bridge assembly wherein the receiving body is rotatable relative to the main body between the first position and the second position.

The foregoing valve bridge assembly wherein the receiving body is a bushing and the key-receiver is formed on an inner surface of the bushing.

The foregoing valve bridge assembly further including an actuator configured to engage the receiving body to move the receiving body between the first position and the second position.

The foregoing valve bridge assembly wherein the actuator rotates the receiving body between the first position and the second position.

The foregoing valve bridge assembly wherein a spring biases the actuator into a first actuator position corresponding to the receiving body being in the first position.

The foregoing valve bridge assembly wherein the actuator includes a plurality of teeth configured to engage mating teeth of the receiving body for moving the receiving body between the first position and the second position.

The foregoing valve bridge assembly further including an actuation device for moving the actuator, the actuation device being at least one of a pneumatic device, a hydraulic device or an electric device.

The foregoing valve bridge assembly wherein the piston body is movable in an axial direction relative to the main body.

The foregoing valve bridge assembly wherein the piston body is movable between a first disengage position relative to the main body wherein the receiving body is free to move between the first position and the second position and a second engaged position relative to the main body wherein the key or protrusion and the key receiving slot or groove are in engagement and the receiving body is locked into the second position.

The foregoing valve bridge assembly further including a spring for biasing the piston body to the first disengaged position.

The foregoing valve bridge assembly further including a guide element configured to engage the key of the piston body to fix the piston body in a predetermined rotational orientation relative to the main body.

The foregoing valve bridge assembly wherein the receiving body includes a stop wherein when the receiving body is in the second position the piston body moves a predetermined distance before engaging the stop and, once the piston body engages the stop, the force applied to the piston body is then transmitted to the at least one valve stem via the receiving body and the main body.

The foregoing valve bridge assembly wherein the key-receiver is a plurality of slots or grooves provided on the receiving body and the key is a plurality of protrusions provided on the piston body.

The foregoing valve bridge assembly wherein the receiving body is a bushing and the plurality of slots or grooves are provided on an inner surface of the receiving body and the plurality of protrusions are provided on an outer surface of the piston body.

There is also provided a method for selectively transferring a force from a rocker arm of an engine to at least one valve stem via a valve bridge assembly, the valve bridge assembly including a main body configured to engage a distal end of the at least one valve stem, a receiving body movably disposed within a cavity of the main body between a first position and a second position, the receiving body including at least one key-receiver and a piston body movably attached to the main body and including a key configured to be received into the key-receiver of the receiving body. The method includes selectively positioning the receiving body in the first position, wherein the key-receiver and the key are misaligned and wherein a force applied to the piston body is transmitted to the at least one valve stem via the receiving body and the main body and selectively positioning the receiving body in the second position, wherein the key-receiver and the key are aligned and wherein a force applied to the piston body causes the piston body to be displaced relative to the main body.

The foregoing method further including selectively moving an actuator in engagement with the receiving body for moving the receiving body between the first position and the second position.

The foregoing method wherein the receiving body is rotatable relative to the main body between the first position and the second position.

The foregoing method wherein the receiving body includes a stop and the step of selectively positioning the receiving body in the second position further includes moving the piston body into engagement with the stop wherein the force applied to the piston body causes the piston body to move a predetermined distance before contacting the stop.

The foregoing method further comprising an actuator in engagement with the receiving body, wherein the steps of selectively positioning the receiving body in the first position and selectively positioning the receiving body in the second position include applying a force from at least one of a pneumatic device, a hydraulic device or an electric device to the actuator to move the receiving body.

DETAILED DESCRIPTION

The following presents a description of the disclosure; however, aspects may be embodied in many different forms and should not be construed as limited to the embodiments set forth herein. Furthermore, the following examples may be provided alone or in combination with one or any combination of the examples discussed herein. Directional references such as "left" and "right" are for ease of reference to the figures.

Figure 1:
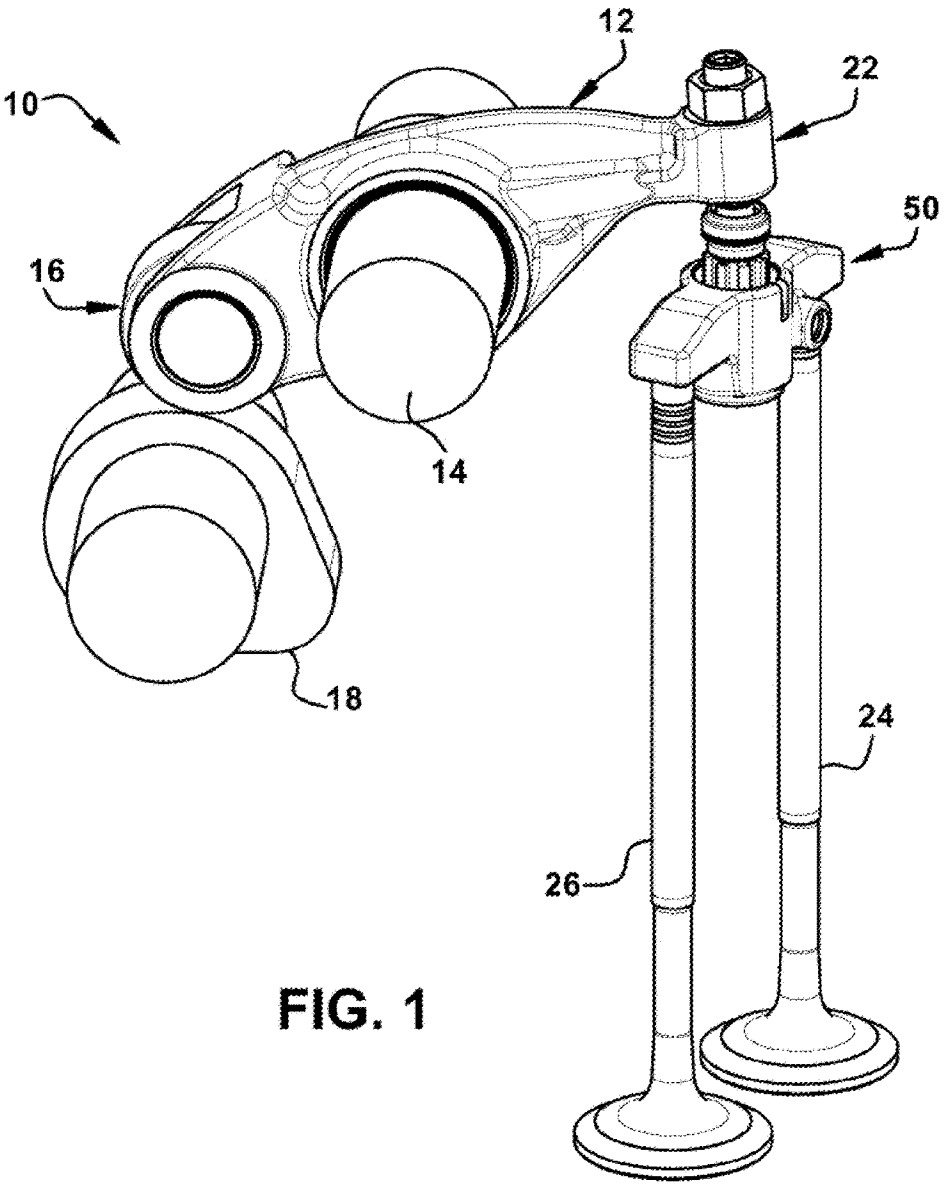
FIG. 1 is a perspective view of a rocker arm assembly having a valve bridge assembly.

With reference to FIG. 1, the rocker arm assembly 10 is shown to include a rocker arm 12 that is configured to rotate about a shaft 14. A roller end 16 of the rocker arm 12 is configured engage a cam 18 that causes the rocker arm 12 to rotate about the shaft 14. A valve end 22 of the rocker arm 12 is configured to selectively drive valves 24, 26 when the rocker arm 12 rotates about the shaft 14.

Figure 2:
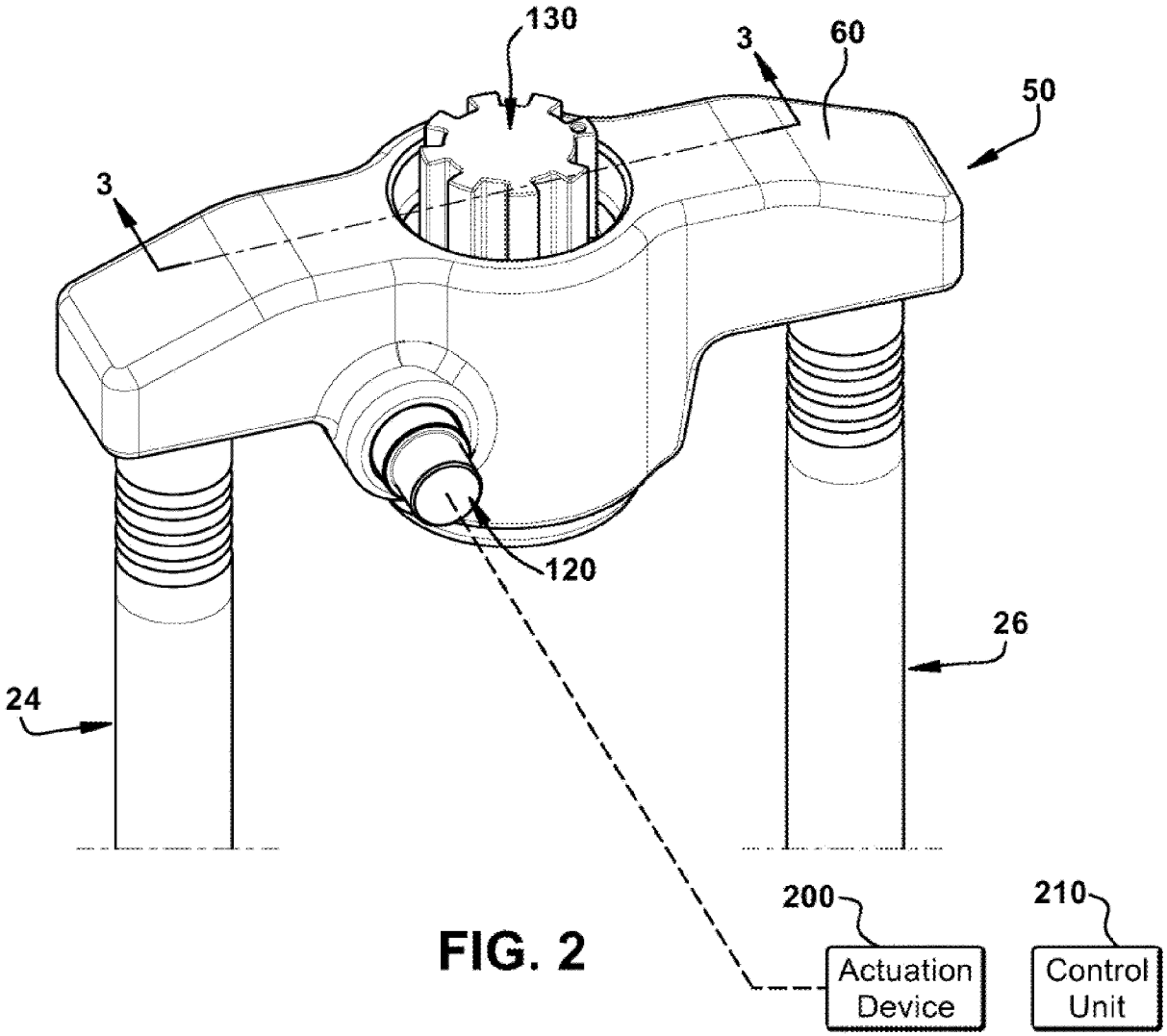
FIG. 2 is an enlarged perspective of the valve bridge assembly engaged with two valves.

Referring to FIG. 2, a valve bridge assembly 50 is configured to engage the valve end 22 of the rocker arm 12. A body 60 of the valve bridge assembly 50 is configured to engage the valves 24, 26 so that the valve bridge assembly 50 may transfer the rotational movement of the rocker arm 12 (FIG. 1) to vertical movement of the valves 24, 26.

Figure 4:
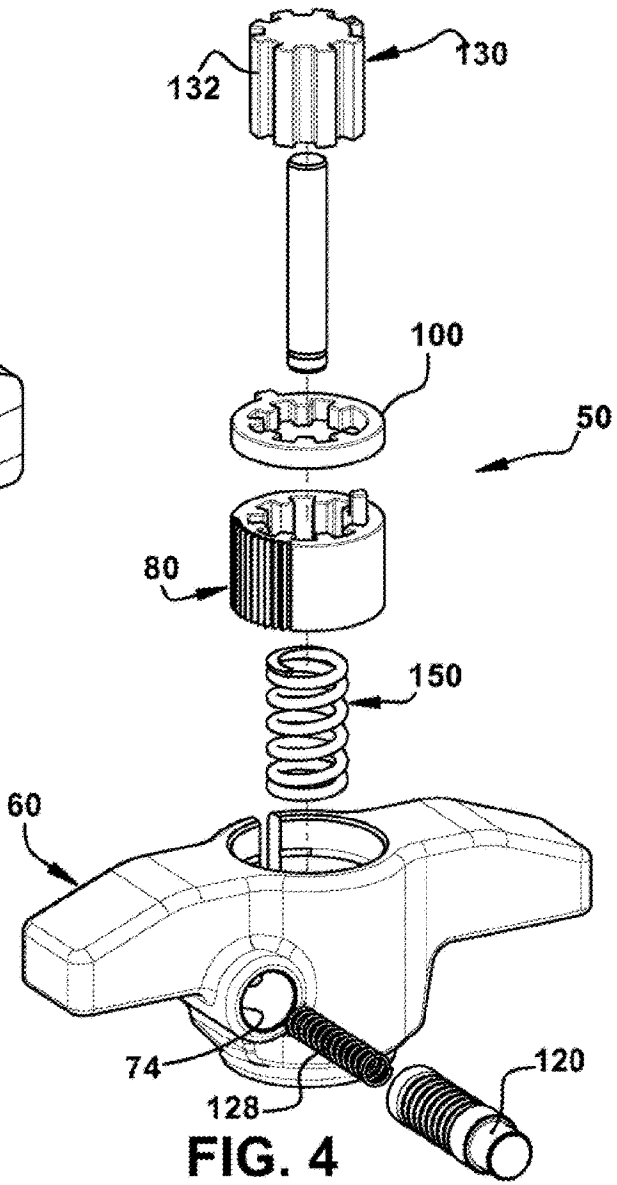
FIG. 4 is an exploded view of the valve bridge assembly of FIG. 3.
Figure 3:
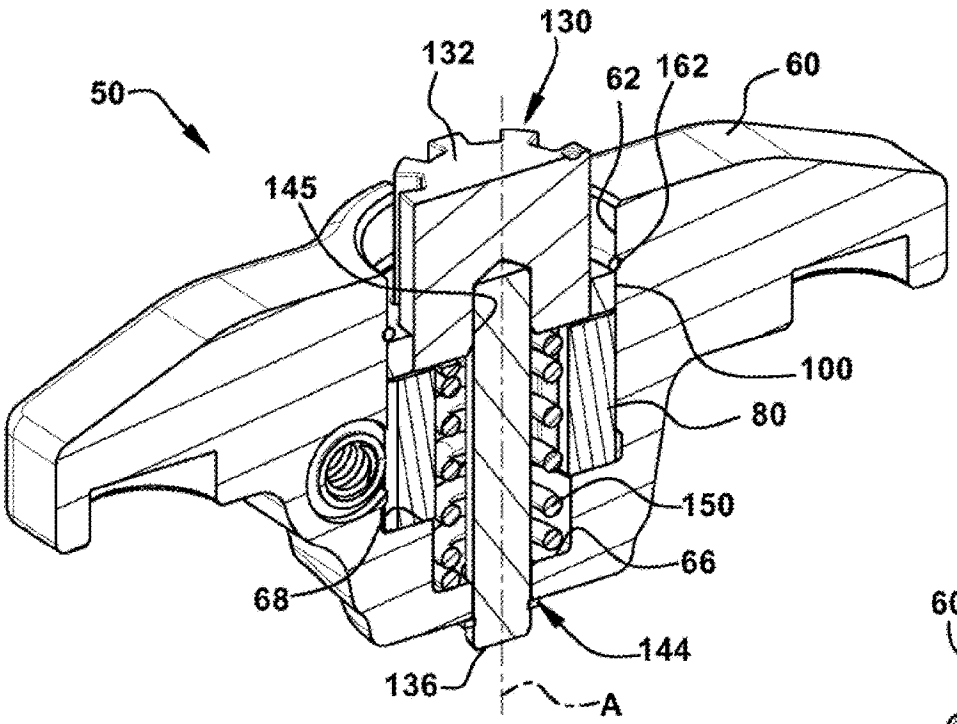
FIG. 3 is sectional view of the valve bridge assembly of FIG. 2 taken along line 3-3 of FIG. 2.

Referring to FIGS. 3 and 4, the valve bridge assembly 50 includes the body 60, a receiving body 80 (also referred to as an outer spline bushing), a spline guide 100, an actuator 120 and a piston assembly 130 (also referred to as an inner spline bushing assembly) and a spring 150.

Figure 6:
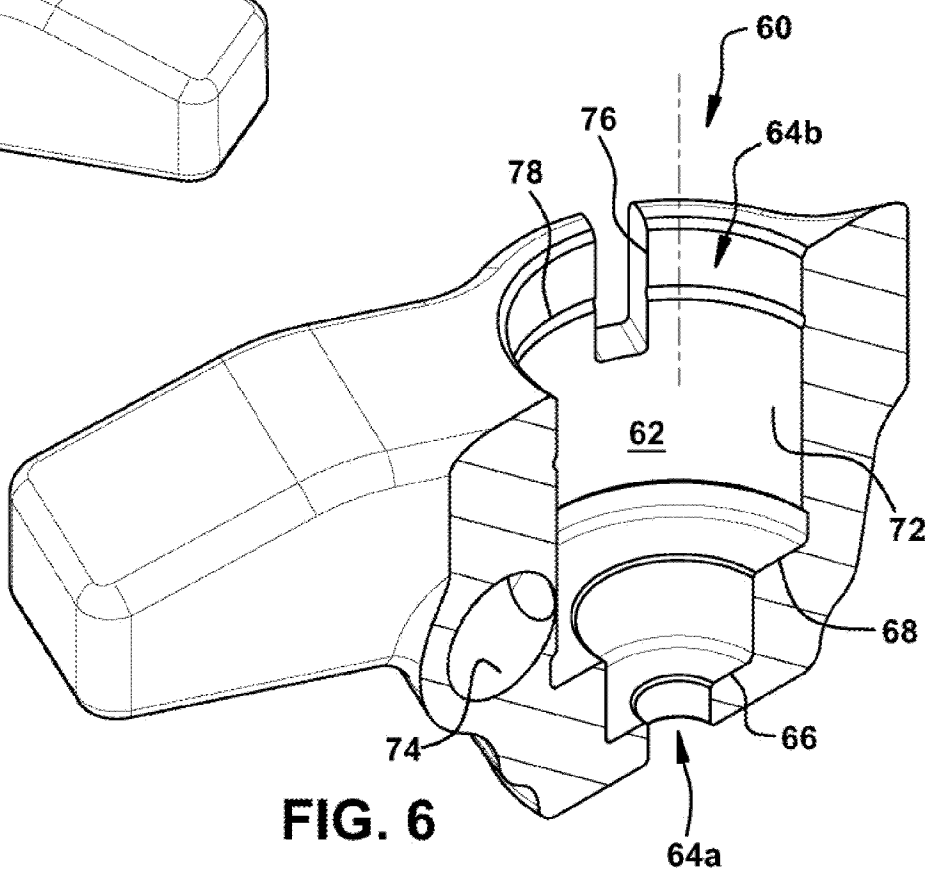
FIG. 6 is a sectional view taken along line 6-6 of FIG. 5.
Figure 5:
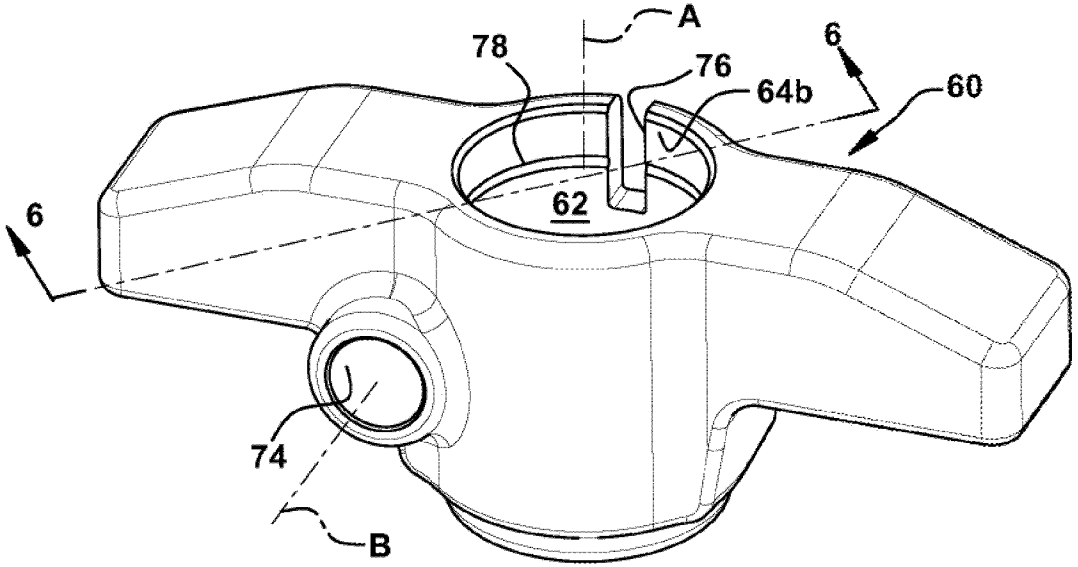
FIG. 5 is an enlarged perspective view of a body of the valve bridge assembly of FIG. 3.

Referring to FIGS. 5-6, the body 60 includes a hole 62 that extends through the body 60 and defines a main axis A of the body 60. An inner wall of the hole 62 is contoured to define a first seat 66 near a lower opening 64*a* of the hole 62. A second seat 68 is provided above the first seat 66. A cylindrical wall 72 is provided above the second seat 68 and extends to an upper opening 64*b* of the hole 62.

A cross-hole 74 extends tangentially through the body 60 and intersects the hole 62 in the cylindrical wall 72. The cross-hole 74 defines a secondary axis B of the body 60. The cross-hole 74 is configured to receive the actuator 120 (FIG. 2), as described in detail below. An elongated slot 76 is formed in an upper edge of the body 60 at the upper opening 64*b*. The slot 76 extends axially from the upper opening 64*b* into the cylindrical wall 72. A peripheral groove 78 is formed in the cylindrical wall 72 near the upper opening 64*b*.

Figure 7:
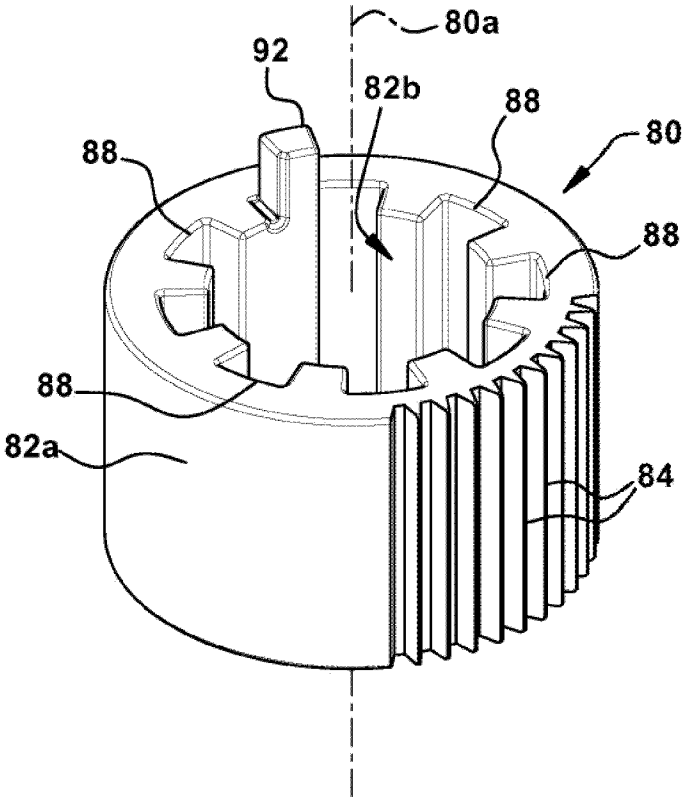
FIG. 7 is an enlarged perspective view of a receiving body of the valve bridge assembly of FIG. 3.

Referring back to FIG. 3, the receiving body 80 (i.e., the outer spline bushing) is configured to be rotatably received in the hole 62 of the body 60. Referring to FIG. 7, the receiving body 80 is a cylindrical-shaped element having an outer cylindrical surface 82*a* and an inner cylindrical surface 82*b* that defines a longitudinal axis 80*a* of the receiving body 80. A plurality of axially extending teeth 84 are provided in the outer cylindrical surface 82*a*.

Figure 8:
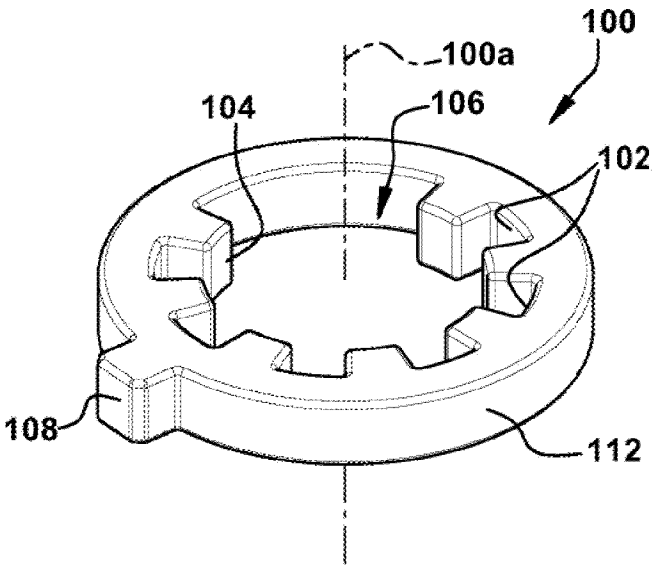
FIG. 8 is an enlarged perspective view of a spline guide of the valve bridge assembly of FIG. 3.

The inner cylindrical surface 82*b* is contoured to define a plurality of spaced-apart, key-receivers 88 that extend axially along the inner cylindrical surface 82*b*. In the embodiment illustrated, the key-receivers 88 are slots or grooves and there are eight slots or grooves. It is contemplated that the receiving body 80 may include any number of key-receivers 88. A tab 92 extends axially from an upper end of the receiving body 80 and is dimensioned and positioned as described in detail below Referring back to FIG. 3, the spline guide 100 is positioned within the hole 62 above the receiving body 80. Referring to FIG. 8, the spline guide 100 is a ring-shaped element having a longitudinal axis 100*a*. A plurality of spaced-apart guide grooves 102 are formed on an inner wall 104 of the spline guide 100. A portion of the inner wall 104 includes an enlarged opening 106 that is dimensioned to receive the tab 92 (FIG. 7) of the receiving body 80, as described in detail below. A tab 108 extends radially outward from an outer wall 112 of the spline guide 100.

Figure 9:
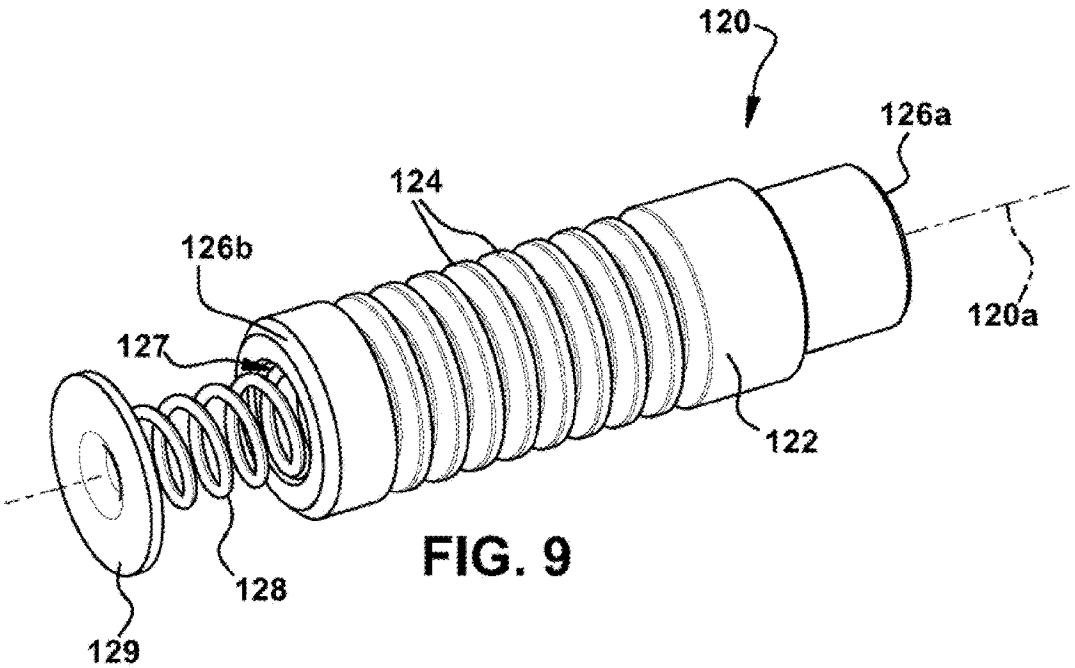
FIG. 9 is an exploded view of components associated with an actuator of the valve bridge assembly of FIG. 3.

Referring to FIG. 4, the actuator 120 is inserted into the cross-hole 74. Referring now to FIG. 9, the actuator 120 is a rod-shaped element having a longitudinal axis 120*a*. A plurality of spaced-apart, ring-shaped grooves 124 are formed in an outer cylindrical surface 122 of the actuator 120. The actuator 120 includes a first, engagement end 126*a* and a second end 126*b* that is configured to receive a spring 128. In the embodiment illustrated, the second end 126*b* includes a counterbored hole 127 (FIG. 11B) to receive the spring 128. A washer 129 provides a surface against which the spring 128 is compressed when assembled into the body 60, as described in detail below.

Figure 10:
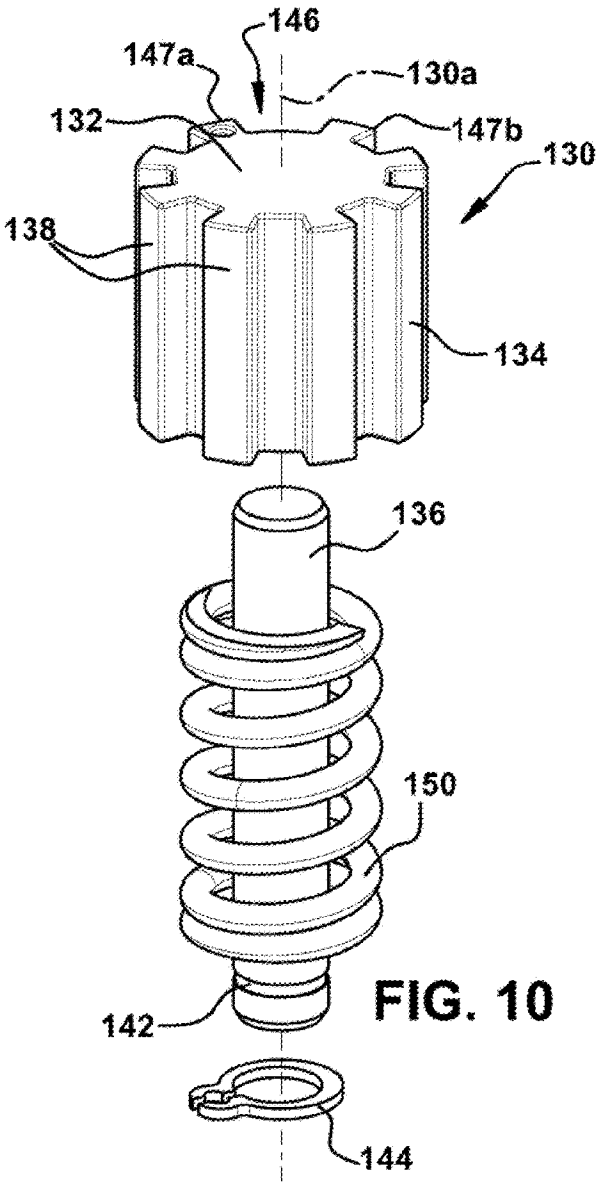
FIG. 10 is an exploded view of a piston assembly of the valve bridge assembly of FIG. 3.

Referring back to FIG. 3, the piston assembly 130 is dimensioned and configured to move axially along axis A within the hole 62 of the body 60. Referring to FIG. 10, the piston assembly 130 includes a piston body 132 that defines a longitudinal axis 130*a* and a stem 136 that extends axially from a lower end of the piston body 132. A plurality of axially extending keys 138 extend from an outer surface 134 of the piston body 132 about a periphery of the piston body 132. In the embodiment illustrated, the keys 138 are a plurality of protrusions that extend from the outer surface 134. A peripheral groove 142 is formed in the outer surface of the stem 136 near a distal end thereof. The groove 142 is configured to receive a retaining ring 144 when assembled, as described in detail below.

In the embodiment illustrated, the piston body 132 and the stem 136 are separate components and the piston body 132 includes a hole 145 (FIG. 3) that extends into a lower end of the piston body 132. The hole 145 is dimensioned to receive an upper end of the stem 136. The stem 136 is fixed to the piston body 132 by one or more means, including but limited, threading, press fit, welding, etc. It is contemplated that the piston body 132 and the stem 136 may be made as a single unitary piece. The spring 150 is dimensioned to be received around the stem 136, as described in detail below.

Figure 11B:
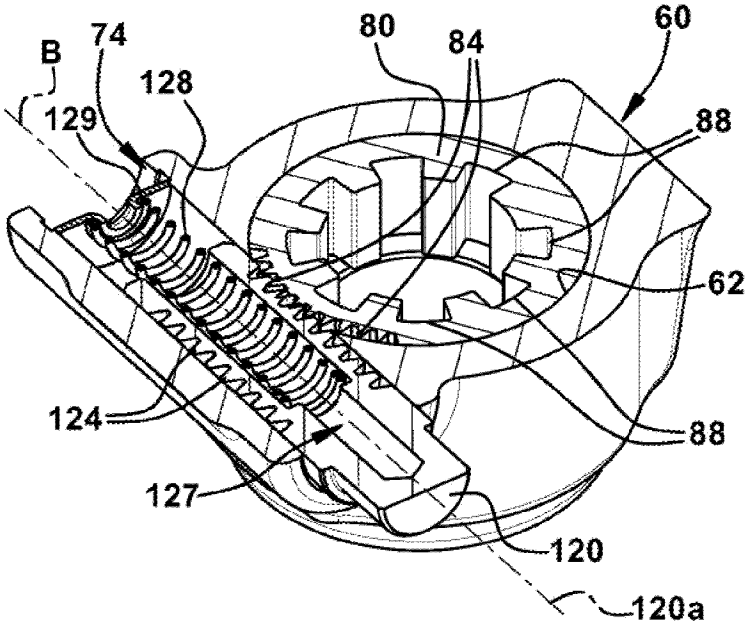
FIG. 11B is a sectional view taken along line 11B-11B of FIG. 11A.
Figure 11A:
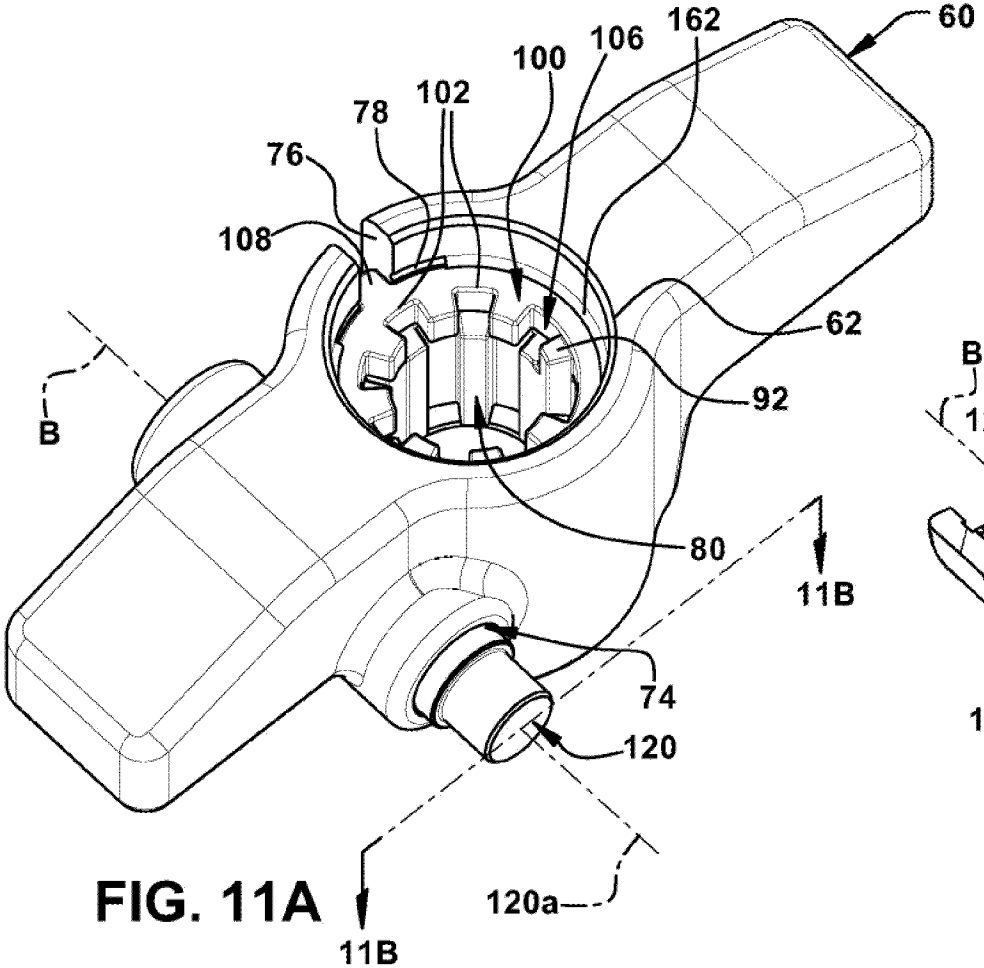
FIG. 11A is a perspective view of a partially assembled valve bridge assembly.

Referring to FIGS. 11A and 11B, the valve bridge assembly 50 is assembled by inserting the washer 129, the spring 128 and the actuator 120 into the cross-hole 74 such that the longitudinal axis 120*a* of the actuator 120 aligns with the secondary axis B of the body 60. The spring 128 is compressed between the washer 129 and a bottom of the counterbored-hole 127 to apply a biasing force to the actuator 120 that is directed away from the washer 129 and out of the hole 62. In this respect, the spring 128 biases the actuator 120 to a first actuator position. The actuator 120 is dimensioned and configured to move axially along the secondary axis B when actuated, as discussed in detail below. The actuator 120 is dimensioned so that when it is fully inserted into the cross-hole 74, the plurality of spaced-apart, ring-shaped grooves 124 extend into the hole 62 of the body.

With the actuator 120 inserted into the cross-hole 74, the receiving body 80 is then inserted into the hole 62 such that the longitudinal axis 80*a* (FIG. 7) aligns with the longitudinal axis A (FIG. 5) of the body 60. As the receiving body 80 is inserted into the hole 62, the vertical teeth 84 on the receiving body 80 engage the spaced-apart, ring-shaped grooves 124 of the actuator 120. The engagement between the vertical teeth 84 and the spaced-apart, ring-shaped grooves 124 is configured to convert axial movement of the actuator 120 to rotational movement of the receiving body 80. The receiving body 80 continues to be inserted until the hole 62 until the receiving body 80 rests on the second seat 68 of the hole 62 (see FIG. 3).

The spline guide 100 is then placed on the receiving body 80 such that the tab 92 of the receiving body 80 is received into the enlarged opening 106 and the tab 108 of the spline guide 100 is received into the slot 76 in the body 60. The tab 108 is configured to fix the rotational position of the spline guide 100 relative to the hole 62 in the body 60. Once the spline guide 100 is seated on the receiving body 80, a retaining ring 162 (FIGS. 3 and 11A) is inserted into the peripheral groove 78 to retain both the receiving body 80 and the spline guide 100 in the body 60.

The body 60, the receiving body 80, the spline guide 100 and the actuator 120 are all dimensioned such that axial movement of the actuator 120 along the secondary axis B causes the ring-shaped grooves 124 of the actuator 120 to engage the teeth 84 of receiving body 80 to impart rotation to the receiving body 80. When the actuator 120 is in the first actuator position, the receiving body is in a first activated position, as described in detail below. The tab 108 on the spline guide 100 prevents that spline guide 100 from rotating with the receiving body 80.

Figure 12B:
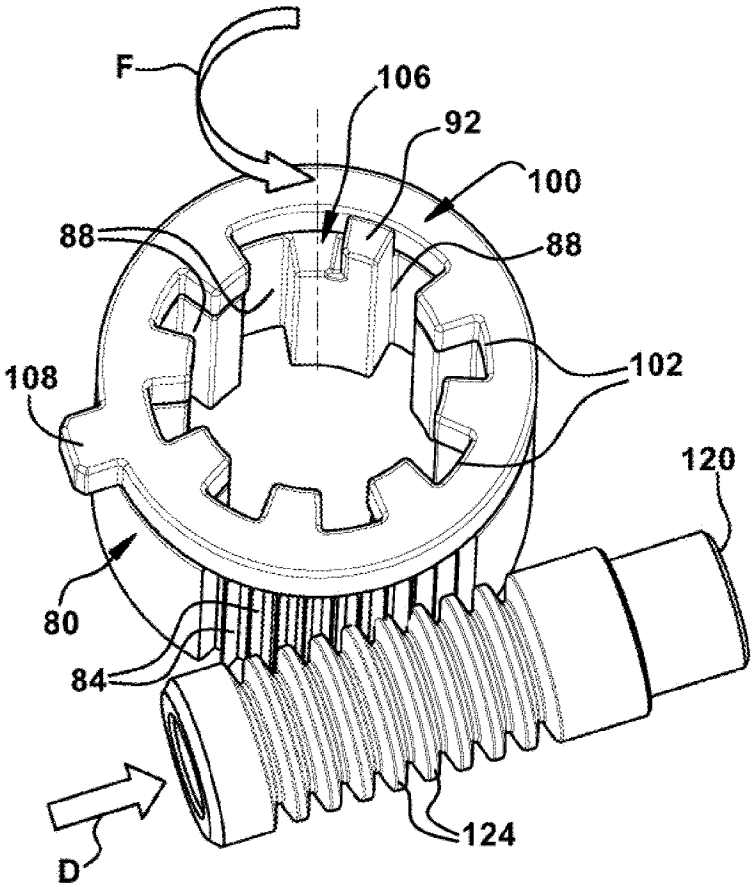
FIG. 12B is a perspective view of various components of the valve bridge assembly in a second, deactivated position.
Figure 12A:
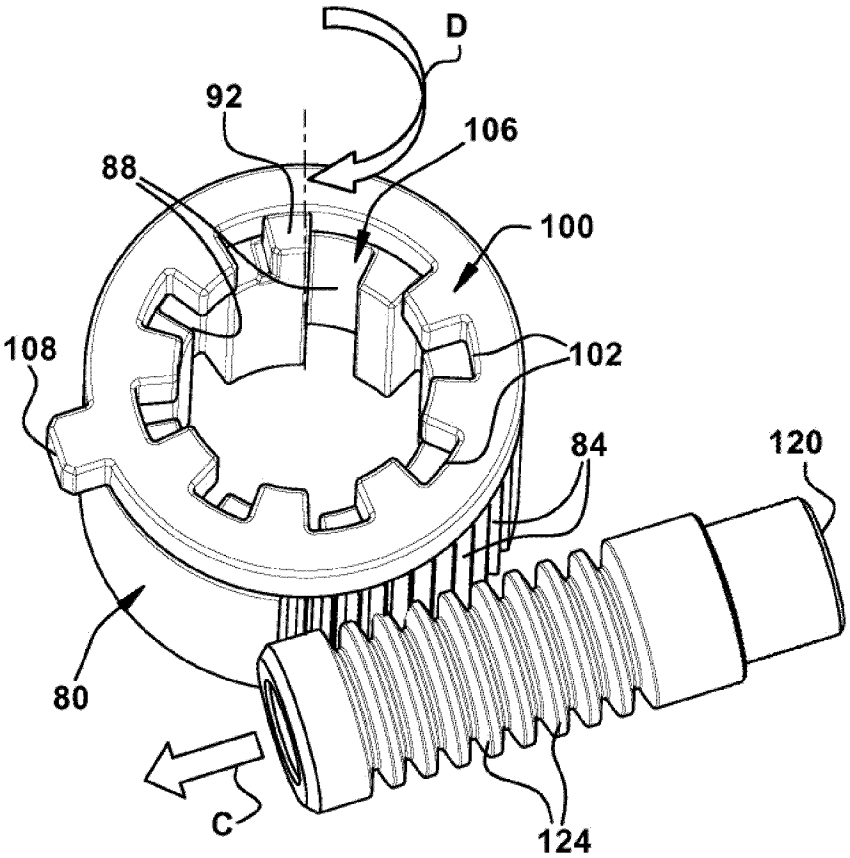
FIG. 12A is a perspective view of various components of the valve bridge assembly in a first, activated position.

Referring to FIG. 12A, when the receiving body 80 is in the first activated position, the guide groove 102 of the spline guide 100 is out of alignment with the key-receiver 88 of the receiving body 80. Axially moving the actuator 120 in the direction of the arrow C in FIG. 12A (i.e., from the first actuator position to a second actuator position) causes the receiving body 80 to rotate in the clockwise direction (when viewed from the spline guide 100), as represented by the arrow D. As the actuator 120 is translated a predetermined distance to the second actuator position, the receiving body 80 is rotated to the second, deactivated position wherein the guide groove 102 of the spline guide 100 align with the key-receiver 88 of the receiving body 80, see, FIG. 12B. Translating the actuator 120 in the opposite direction (see arrow E in FIG. 12B) back to the first, actuator position causes the receiving body 80 to rotate in the counter-clockwise direction (when viewed from the spline guide 100), as represented by arrow F. The receiving body 80 rotates until it returns to the first activated position. In this respect, axial movement of the actuator 120 along the secondary axis B of the body 60 between the first actuator position and the second actuator position causes the receiving body 80 to pivot between the first activated position (FIG. 12A) and the second deactivated position (FIG. 12B), respectively.

It is contemplated that in alternative embodiment that first actuator position of the actuator 120 may correspond to the second deactivated position of the receiving body 80 and the second actuator position of the actuator 120 may correspond to the first activated position of the receiving body 80. In this alternative embodiment the receiving body 80 is biased to the second deactivated position. It is also contemplated that instead of utilizing a spring to return the actuator 120 to the first actuator position that the actuator 120 may be positively driven in both directions via an actuation device 200 which may include, but not be limited to, a pneumatic device (e.g., an air pump), a hydraulic device (e.g., a fluid pump) or an electric device (e.g., a motor). See, FIG. 2.

Referring back to FIGS. 3 and 4, the spring 150 is inserted into the receiving body 80 until a lower end of the spring 150 rests on the first seat 66 of the hole 62. Thereafter, the piston body 132 and stem 136 are inserted into the receiving body 80 such that the spring 150 is compressed between a bottom of the piston body 132 and the first seat 66.

Figure 12C:
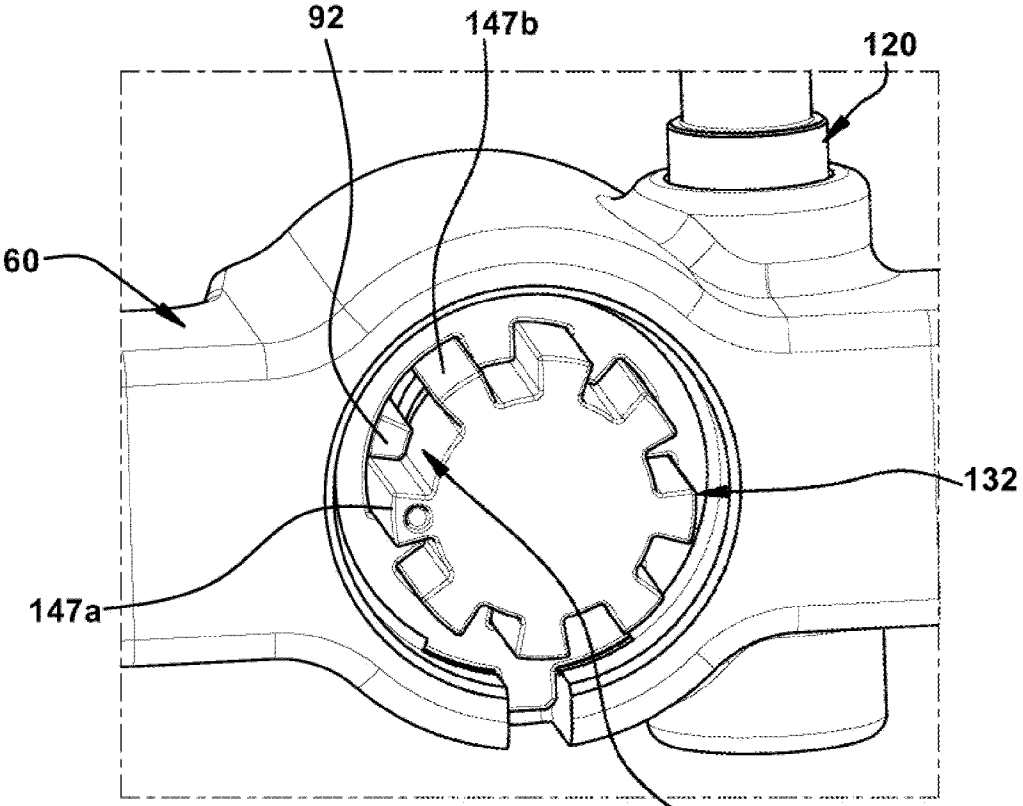
FIG. 12C is a perspective view of a top of the valve bridge assembly.

The piston assembly 130 is rotated until the keys 138 (FIG. 10) on the piston body 132 aligns with the guide grooves 102 (FIG. 8) on the spline guide 100. Referring to FIG. 12C, the piston assembly 130 is positioned so that the tab 92 on the receiving body 80 extends into an enlarged opening 146 between adjacent keys 147*a*, 147*b*. The enlarged opening 146 defines a space wherein the tab 92 may move when the receiving body 80 moves between the first and second positions. The adjacent keys 147*a*, 147*b* also function as stops for defining when the receiving body 80 has reached the respective first and second positions. Once aligned, the rotational orientation of the piston assembly 130 is fixed and the piston assembly 130 is free to translate axially along the longitudinal axis A of the body 60 and is restrained from rotating by the spline guide 100.

A retaining ring 144 is placed in the peripheral groove 142 (FIG. 10) on the stem 136 to prevent the piston assembly 130 from being removed from the body 60 during operation. The spring 150 biases the piston body 132 in an upward direction to a first disengaged position wherein the key 138 of the piston body 132 is disengaged from the key-receiver 88 of the receiving body 80. In this position, the receiving body 80 is free to rotate about the axis A between the first activated position and the second deactivated position.

The valve bridge assembly 50 will now be described with respect the operation of the same. As noted above, axial translation of the actuator 120 along the axis B causes the receiving body 80 to alternate between the first activated position (FIG. 12A) and the second deactivated positioned (FIG. 12B). It is contemplated that movement of the actuator 120 may be controlled using force from the actuation device 200 that is controlled by a control unit 210 (both schematically illustrated in FIG. 2).

Figure 14:
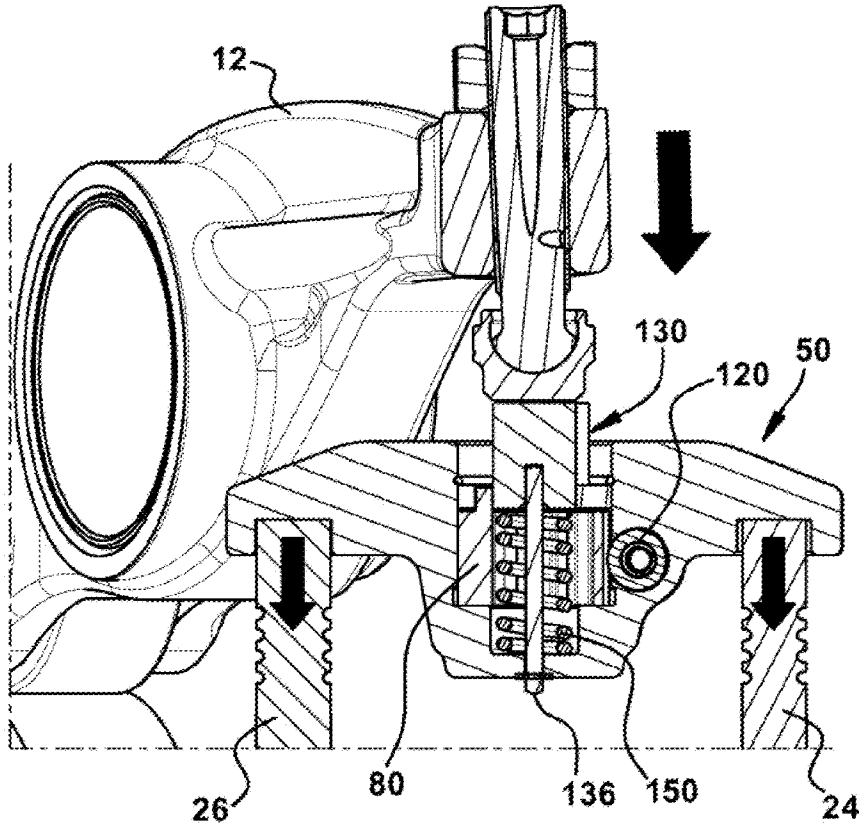
FIG. 14 is a partial sectional view of the rocker arm assembly in a lowered position and the valve bridge assembly in an activated position.
Figure 13:
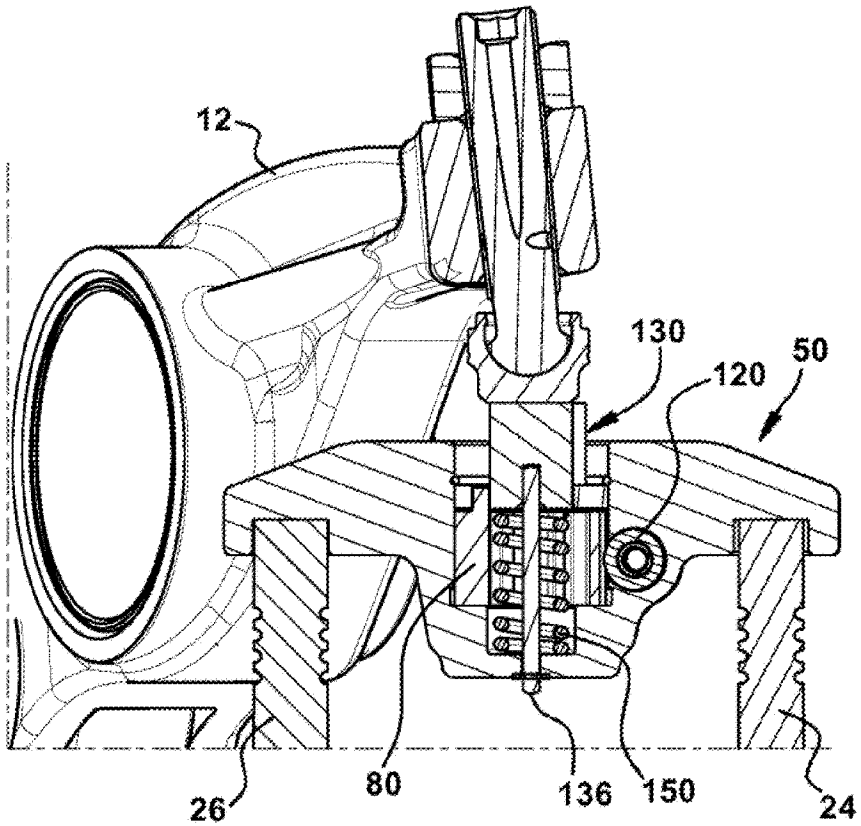
FIG. 13 is a partial sectional view of the rocker arm assembly in an upper position and the valve bridge assembly in an activated position.
Figure 15:
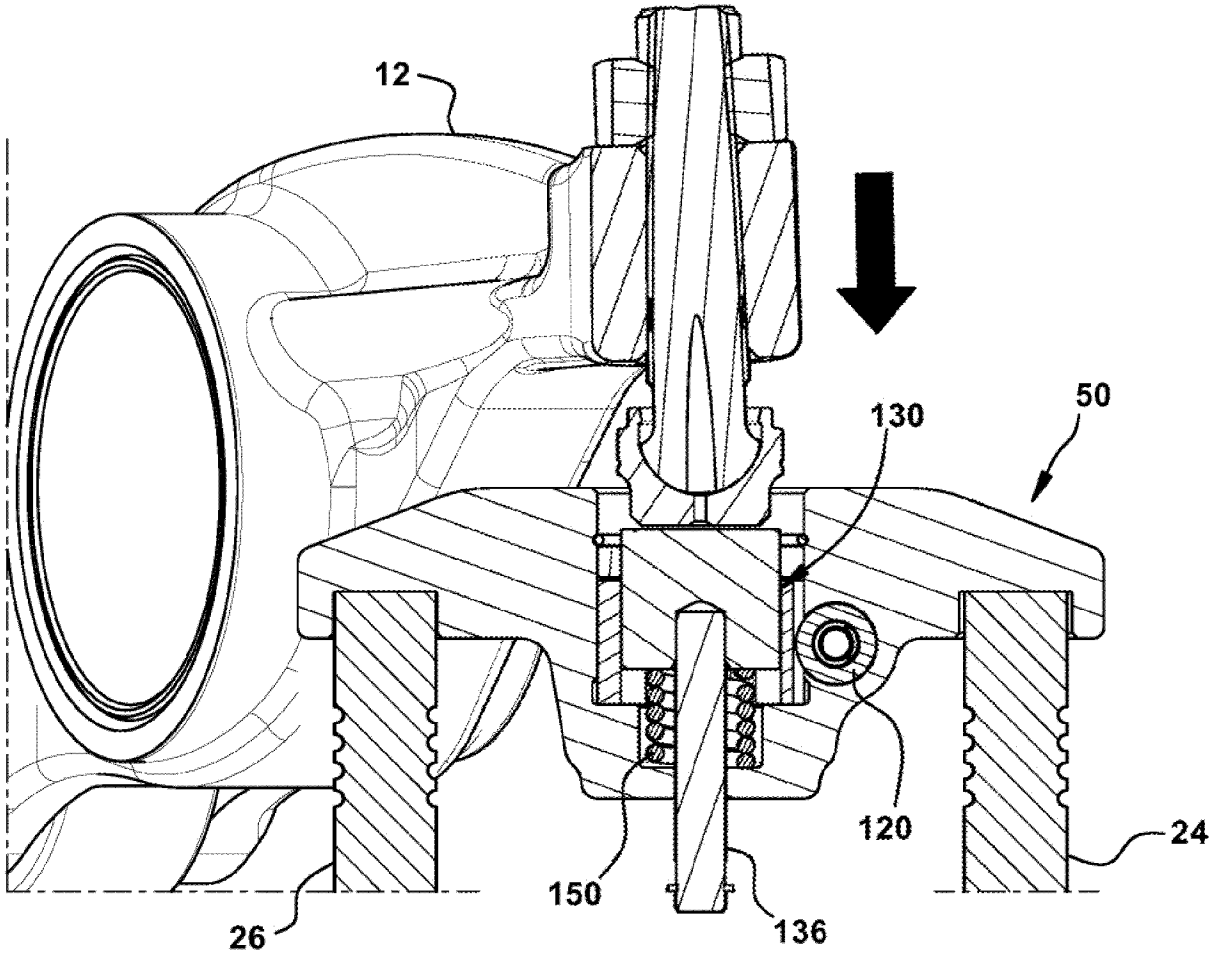
FIG. 15 is a partial sectional view of the rocker arm assembly in a lowered position and the valve bridge assembly in a deactivated position.

Referring to FIGS. 13 and 14, when the actuator 120 positions the receiving body 80 in the first activated position (FIG. 12A), the guide grooves 102 in the spline guide 100 and the key 138 is out of alignment with the key-receiver 88 of the receiving body 80. As a force is applied to the piston assembly 130 via the rocker arm 12, the force is transmitted to the piston body 132, the receiving body 80, the body 60 and to the valves 24, 26 that are in engagement with the body 60. As illustrated in FIG. 14, the force from the rocker arm 12 causes the valves 24, 26 to move.

When the actuator 120 moves the receiving body 80 to the second deactivated position (FIG. 12B), the guide groove 102 in the spline guide 100 and the key 138 align with the key-receiver 88 of the receiving body 80. As a force is applied to the piston assembly 130 via the rocker arm 12, the force causes the piston body 132 to move within the receiving body 80 to a second, engaged position wherein the spring 150 is compressed. The force from the rocker arm 12 is applied to compress the spring 150 and is not applied substantially to the valves 24, 26. When the piston body 132 is the second engaged position, the receiving body 80 is rotationally locked in the second deactivated position.

Figure 16:
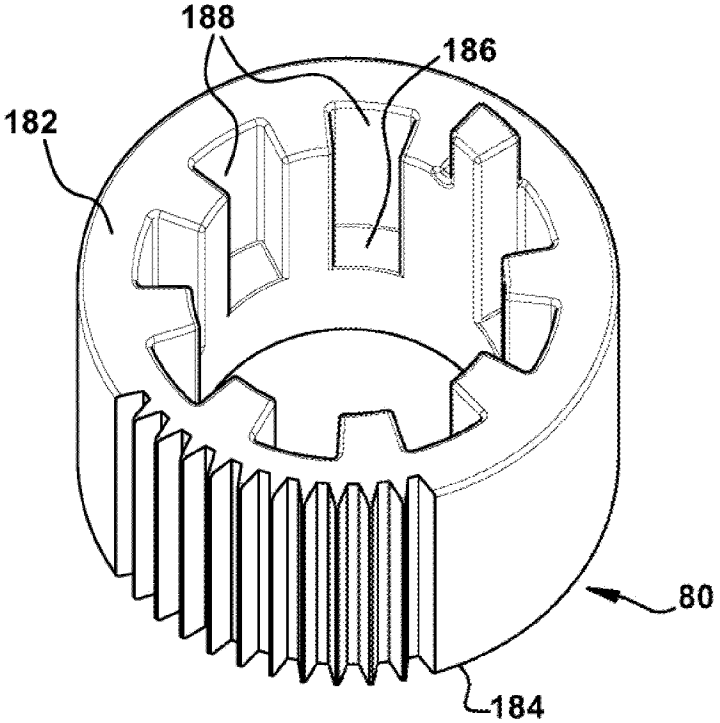
FIG. 16 is a receiving body according to another embodiment.

In the embodiment shown, the key-receiver 88 in the receiving body 80 extends the entire height of the receiving body 80. It is contemplated that, in another embodiment (See FIG. 16), a key-receiver 188 may extend part-way between a top 182 and a bottom 184 of the receiving body 80. In this embodiment, the key-receiver 188 terminates at an intermediate step 186. During operation, when the key-receiver 188 aligns with the guide groove 102 and the keys 138, the piston assembly 130 (when actuated by the rocker arm 12) may initially compress the spring 150 until the keys 138 reach the step 186. At this point, the force from further rotation of the rocker arm 12 will be translated through the valve bridge assembly 50 to the valves 24, 26. This embodiment allows for delayed actuation of the valves 24, 26 for instances where variable valve lift is desired.

It will be apparent to those skilled in the art that various modifications and variations can be made without departing from the spirit and scope of the claimed invention.

What we claim is:

1. A valve bridge assembly for an engine comprising:

a main body configured to engage a distal end of at least one valve stem;

a receiving body movably disposed within a cavity of the main body between a first position and a second position, the receiving body including at least one key-receiver;

a piston body movably attached to the main body and including a key configured to be received into the at least one key-receiver of the receiving body; and an actuator includes a plurality of teeth configured to engage mating teeth of the receiving body for moving the receiving body between the first position and the second position, wherein, when the receiving body is in the first position, the at least one key-receiver and the key are misaligned and a force applied to the piston body is transmitted to the at least one valve stem via the receiving body and the main body, and when the receiving body is in the second position, the at least one key-receiver and the key are aligned and a force applied to the piston body causes the piston body to be displaced relative to the main body.

2. The valve bridge assembly of claim 1, wherein the receiving body is rotatable relative to the main body between the first position and the second position.

3. The valve bridge assembly of claim 1, wherein the receiving body is a bushing and the at least one key-receiver is formed on an inner surface of the bushing.

4. The valve bridge assembly of claim 1, wherein the actuator rotates the receiving body between the first position and the second position.

5. The valve bridge assembly of claim 1, wherein a spring biases the actuator into a first actuator position corresponding to receiving body being in the first position.

6. The valve bridge assembly of claim 1, further comprising an actuation device for moving the actuator, the actuation device being a pneumatic device, a hydraulic device, or an electric device.

7. The valve bridge assembly of claim 1, wherein the piston body is movable in an axial direction relative to the main body.

8. The valve bridge assembly of claim 7, wherein the piston body is movable between a first disengaged position relative to the main body wherein the receiving body is free to move between the first position and the second position and a second engaged position relative to the main body wherein the key and the at least one key-receiver are in engagement and the receiving body is locked into the second position.

9. The valve bridge assembly of claim 8, further comprising a spring for biasing the piston body to the first disengaged position.

10. The valve bridge assembly of claim 1, further comprising a guide element configured to engage the key of the piston body to fix the piston body in a predetermined rotational orientation relative to the main body.

11. The valve bridge assembly of claim 1, wherein the receiving body comprises a stop wherein when the receiving body is in the second position the piston body moves a predetermined distance before engaging the stop and, once the piston body engages the stop, the force applied to the piston body is then transmitted to the at least one valve stem via the receiving body and the main body.

12. The valve bridge assembly of claim 1, wherein the at least one key-receiver is a plurality of slots or grooves provided on the receiving body and the key is a plurality of protrusions provided on the piston body.

13. The valve bridge assembly of claim 12, wherein the receiving body is a bushing and the plurality of slots or grooves are provided on an inner surface of the receiving body and the plurality of protrusions are provided on an outer surface of the piston body.

14. A method for selectively transferring a force from a rocker arm of an engine to at least one valve stem via a valve bridge assembly, the valve bridge assembly comprising a main body configured to engage a distal end of the at least one valve stem, a receiving body movably disposed within a cavity of the main body between a first position and a second position, the receiving body including at least one key-receiver, a piston body movably attached to the main body and including a key configured to be received into the at least one key-receiver of the receiving body, and an actuator including a plurality of teeth configured to engage mating teeth of the receiving body for moving the receiving body between the first position and the second position, the method comprising:

selectively positioning the receiving body in the first position, wherein the at least one key-receiver and the key are misaligned and wherein a force applied to the piston body is transmitted to the at least one valve stem via the receiving body and the main body; and selectively positioning the receiving body in the second position, wherein the at least one key-receiver and the key are aligned and wherein a force applied to the piston body causes the piston body to be displaced relative to the main body.

15. The method of claim 14, further comprising:

selectively moving the actuator in engagement with the receiving body for moving the receiving body between the first position and the second position.

16. The method of claim 14, wherein the receiving body is rotatable relative to the main body between the first position and the second position.

17. The method of claim 14, wherein the receiving body includes a stop and the step of selectively positioning the receiving body in the second position further comprises:

moving the piston body into engagement with the stop wherein the force applied to the piston body causes the piston body to move a predetermined distance before contacting the stop.

18. The method of claim 14, wherein the steps of selectively positioning the receiving body in the first position and selectively positioning the receiving body in the second position include:

applying a force from at least one of a pneumatic device, a hydraulic device or an electric device to the actuator to move the receiving body.

* * * * *